US005832443A

United States Patent [19]

Kolesnik et al.

[11] Patent Number: 5,832,443

[45] Date of Patent: Nov. 3, 1998

[54] METHOD AND APPARATUS FOR ADAPTIVE AUDIO COMPRESSION AND DECOMPRESSION

[75] Inventors: Victor D. Kolesnik; Irina Bocharova; Boris Kudryashov; Eugene Ovsyannikov; Andrei Trofimov; Boris Troyanovsky, all of St. Petersburg, Russian Federation

[73] Assignees: Alaris, Inc., Fremont; G.T. Technology, Inc., Saratoga, both of Calif.

[21] Appl. No.: 806,075

[22] Filed: Feb. 25, 1997

[51] Int. Cl.[6] ..... G10L 3/02; G10L 9/00

[52] U.S. Cl. ..... 704/500; 704/229

[58] Field of Search ..... 704/500–504, 704/200, 201, 205, 206, 212, 222, 229, 268, 269

[56] References Cited

U.S. PATENT DOCUMENTS

| | | | |
|---|---|---|---|
| 4,472,832 | 9/1984 | Atal et al. | 381/40 |
| 4,736,428 | 4/1988 | Deprettere et al. | 381/38 |
| 4,790,016 | 12/1988 | Mazor et al. | 381/36 |
| 4,817,157 | 3/1989 | Gerson | 381/40 |
| 4,868,867 | 9/1989 | Davidson et al. | 381/36 |
| 4,896,361 | 1/1990 | Gerson | 381/40 |
| 4,912,764 | 3/1990 | Hartwell et al. | 381/38 |
| 4,914,701 | 4/1990 | Zibman | 381/36 |
| 4,924,508 | 5/1990 | Crepy et al. | 381/38 |
| 4,932,061 | 6/1990 | Kroon et al. | 381/80 |
| 4,944,013 | 7/1990 | Gouvianakis et al. | 381/38 |
| 4,969,192 | 11/1990 | Chen et al. | 381/31 |
| 4,980,916 | 12/1990 | Zinser | 381/36 |
| 5,012,518 | 4/1991 | Liu et al. | 381/42 |
| 5,060,269 | 10/1991 | Zinser | 381/38 |
| 5,073,940 | 12/1991 | Zinser et al. | 381/47 |
| 5,177,799 | 1/1993 | Naitoh | 381/34 |
| 5,187,745 | 2/1993 | Yip et al. | 381/36 |
| 5,195,137 | 3/1993 | Swaminathan | 381/32 |
| 5,199,076 | 3/1993 | Taniguchi et al. | 381/36 |

(List continued on next page.)

OTHER PUBLICATIONS

Zinser, Richard L., Koch, Steven R., "Celp Coding at 4.0 KB/SEC and Below: Improvements to FS–1016," IEEE, (1992), pp. 1313–1316.

Lupini, Peter, Cox, Neil B., Cuperman, Vladimir, "A Multi–Mode Variable Rate Celp Coder Based on Frame Classification," pp. 406–409.

Wang, Shihua, Gersho, Allen, "Improved Phonetically–Segmented Vector Excitation Coding at 3.4 KB/S," IEEE, (1992) pp. 1349–1352.

Xiongwei, Zhang, Xianzhi, Chen, "A New Excitation Model for LPC Vocoder at 2.4 KB/S," IEEE, pp. 165–168.

Liu, Y.J., "On Reducing the Bit Rate of a Celp–Based Speech Coder," IEEE, (1992) pp. 149–152.

Hussain, Yunus, Farvardin, Nariman, "Finite–State Vector Quantization Over Noisy Channels and its Application to LSP parameters," IEEE, (1992) pp. II133–II136.

Haagen, Jesper, Neilsen, Henrik, Hansen, Steffen Duus, "Improvements in 2.4 KBPS High–Quality Speech Coding," IEEE, (1992) pp. II145–II148.

(List continued on next page.)

*Primary Examiner*—David R. Hudspeth
*Assistant Examiner*—Susan Wieland
*Attorney, Agent, or Firm*—Blakely, Sokoloff, Taylor and Zafman LLP

[57] ABSTRACT

A method and apparatus for compression and decompression of an audio signal. In encoding an input audio signal, at least a portion of the audio signal is transformed into a set of coefficients. A set of binary vectors associated with the set of coefficients are generated for digitizing the transformed audio signal using a fixed rate adaptive quantization. Information based on the set of binary vectors is combinatorially encoded and output as a bit stream of encoded audio data. The encoded audio data may be stored, transmitted, and/or decoded.

40 Claims, 8 Drawing Sheets

U.S. PATENT DOCUMENTS

| | | | |
|---|---|---|---|
| 5,222,189 | 6/1993 | Fielder | 395/2 |
| 5,233,659 | 8/1993 | Ahlberg | 381/30 |
| 5,235,671 | 8/1993 | Mazor | 395/2 |
| 5,255,339 | 10/1993 | Fette et al. | 395/2 |
| 5,369,724 | 11/1994 | Lim | 395/2.15 |
| 5,388,181 | 2/1995 | Anderson et al. | 395/212 |
| 5,394,508 | 2/1995 | Lim | 395/2.38 |
| 5,414,796 | 5/1995 | Jacobs et al. | 395/2.31 |
| 5,602,961 | 2/1997 | Kolesnik et al. | 704/223 |
| 5,659,659 | 8/1997 | Kolesnik et al. | 704/219 |
| 5,729,655 | 3/1998 | Kolesnik et al. | 704/223 |

OTHER PUBLICATIONS

Babkin, V.F., "A Universal Encoding Method With Nonexponential Work Expenditure for a Source of Independent Messages," Translated from Problemy Peredachi Informatsii, vol. 7, No. 4, pp. 13–21, Oct.–Dec. 1971, pp. 288–294.

Malone, et al. "Trellis–Searched Adaptive Predictive Coding," IEEE (Dec. 1988), pp. 0566–0570.

Malone, et al. "Enumeration and Trellis–Searched Coding Schemes for Speech LSP Parameters," IEEE (Jul. 1993), pp. 304–314.

Campbell, Joseph P. Jr. "The New 4800 bps Voice Coding Standard," Military & Government Speech Tech '89 (Nov. 14, 1989), pp. 1–4.

Atal, Bishnu S. "Predictive coding of Speech at Low Bit Rates," IEEE Transactions on Communications (Apr. 1982), Vol Com–30, No. 4, pp. 600–614.

Davidson, Grant. "Complexity Reduction Methods for Vector Excitation Coding," IEEE (1986), pp. 3055–3058.

Lynch, Thomas J. "Data Compression Techniques and Applications," Van Nostrand Reinhold (1985), pp. 32–33.

Grieder, W., Langi, A., and Kinsner, W., "Codebook Searching for 4.8 KBPS Celp Speech Coder," IEEE (1993), pp. 397–406.

METHOD AND APPARATUS FOR ADAPTIVE AUDIO COMPRESSION AND DECOMPRESSION

BACKGROUND OF THE INVENTION

Field of the Invention

The invention relates to the field of data compression and decompression. More specifically, the invention relates to compression and decompression of audio data representing an audio signal, wherein the audio signal can be speech, music, etc.

Background Information

To allow typical computing systems to process (e.g., store, transmit, etc.) audio signals, various techniques have been developed to reduce (compress) the amount of data required to represent an audio signal. In typical audio compression systems, the following steps are generally performed: (1) a segment or frame of an audio signal is transformed into a frequency domain; (2) transform coefficients representing (at least a portion of) the frequency domain are quantized into discrete values; and (3) the quantized values are converted (or coded) into a binary format. The encoded/compressed data can be output, stored, transmitted, and/or decoded/decompressed.

To achieve relatively high compression/low bit rates (e.g., 8 to 16 kbps) for various types of audio signals (e.g., speech, music, etc.), some compression techniques (e.g., CELP, ADPCM, etc.) limit the number of components in a segment (or frame) of an audio signal which is to be compressed. Unfortunately, such techniques typically do not take into account relatively substantial components of an audio signal. Thus, such techniques result in a relatively poor quality synthesized (decompressed) audio signal due to loss of information.

One method of audio compression that allows relatively high quality compression/decompression involves transform coding (e.g., discrete cosine transform, Fourier transform, etc.). Transform coding typically involves transforming an input audio signal using a transform method, such as low order discrete cosine transform (DCT). Typically, each transform coefficient of a portion (or frame) of an audio signal is quantized and encoded using any number of well-known coding techniques. Transform compression techniques, such as DCT, generally provide a relatively high quality synthesized signal, since a relatively high number of spectral components of an input audio signal are taken into consideration. Unfortunately, transform audio compression techniques require a relatively large amount of computation, and also require relatively high bit rates (e.g., 32 kbps).

Thus, what is desired is a system that achieves relatively high quality compression and/or decompression of audio data using a relatively low bit rate (e.g., 8 . . . 16 kbps).

SUMMARY

A method and apparatus for compression and decompression of an audio signal is provided. According to one aspect of the invention, a set of binary vectors are generated for digitizing the audio signal with fixed rate adaptive quantization. According to another aspect of the invention, digitized audio data representing the audio signal is combinatorially encoded. According to yet another aspect of the invention, combinatorially encoded audio data is decoded.

BRIEF DESCRIPTION OF THE DRAWINGS

The invention may best be understood by referring to the following description and accompanying drawings which illustrate embodiments of the invention. In the drawings.

DETAILED DESCRIPTION

The invention provides a method and apparatus for compression of audio signals (audio is used heretofore to refer to music, speech, background noise, etc.). In particular, the invention achieves a relatively low compression bit rate of audio data while providing a relatively high quality synthesized (decompressed) audio signal. In the following description, numerous specific details are set forth to provide a thorough understanding of the invention. However, it is understood that the invention may be practiced without these details. In other instances, well-known circuits, structures, timing, and techniques have not been shown in detail in order not to obscure the invention.

In one embodiment of the invention, an input audio signal is filtered, and considered as a sequence of digitized samples at a predetermined sample rate. For example, one embodiment uses a sample rate in the range of 8 to 16 kbps. The sequence is partitioned into overlapping "frames" that correspond to portions of the input audio signal. The samples in each frame are transformed using a Fast Fourier Transform. The most substantial transform coefficients (those that exert the most influence on tone quality of an audio signal) are re-ordered and quantized using a fixed rate quantizer that adaptively scales quantization based on characteristics of the input audio signal. The resulting data from the fixed rate quantizer is converted into binary vectors each having a predetermined length and a predetermined number of ones. These binary vectors are then encoded using a combinatorial coding technique. The encoded audio data is further compressed into a bit stream which may be stored, transmitted, decoded, etc.

The invention further provides a method and apparatus for decompression of audio data. In one embodiment of the invention, compressed audio data is received in a bit stream. An audio signal is restored by performing inverse combinatorial coding and inverse Fast Fourier Transform (IFFT) coding on encoded audio data contained in the bit stream. Samples within overlapping frame regions are interpolated, thereby increasing the relative quality of the synthesized signal. In one embodiment, the synthesized signal is further filtered before it is output to be amplified, stored, etc.

COMPRESSION

Overview of Data Compression According to One Embodiment of the Invention

Figure 1:
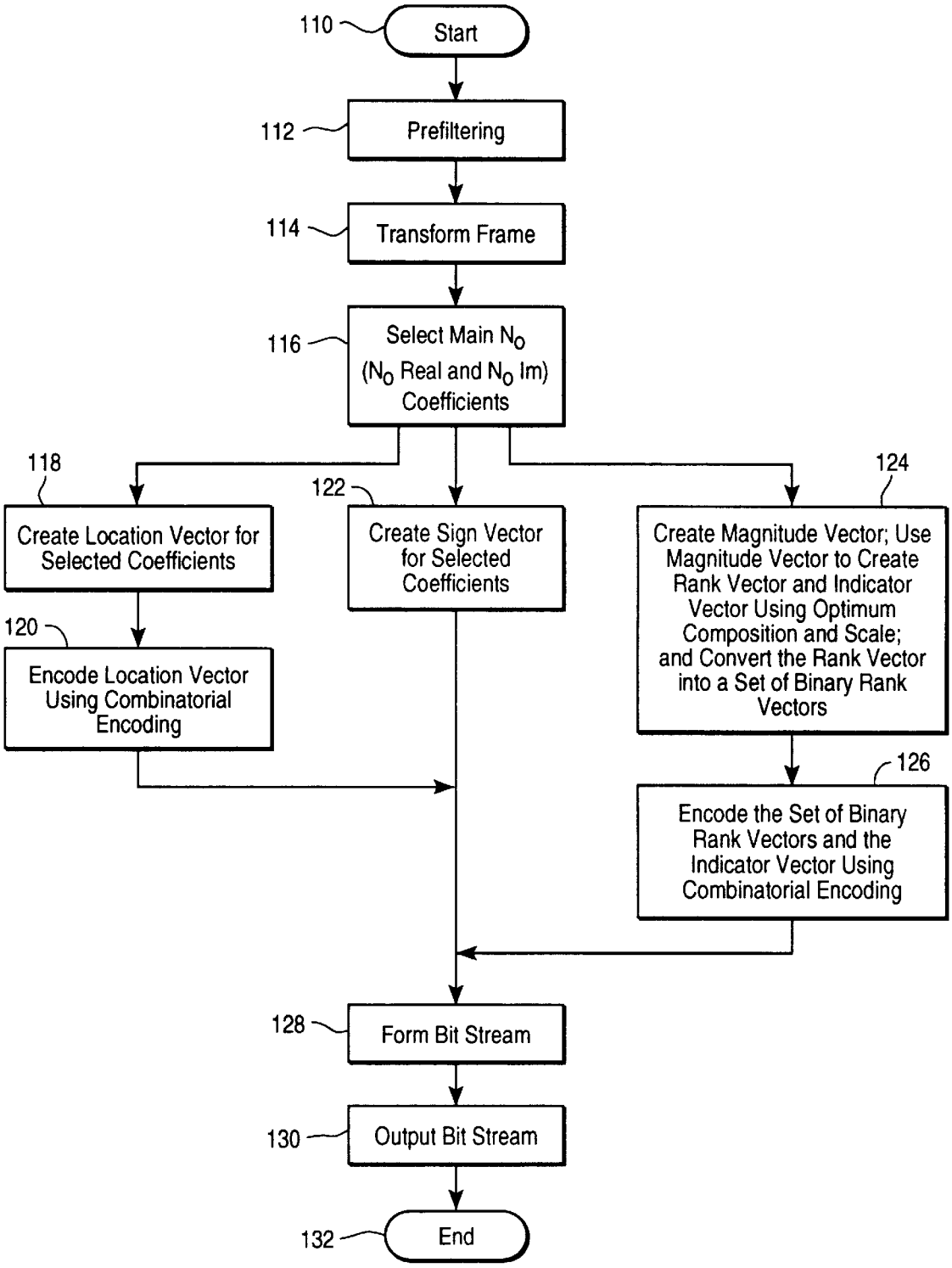
FIG. 1 is a flow diagram illustrating a method for compression of audio data according to one embodiment of the invention.

FIG. 1 is a flow diagram illustrating a method for compression of audio data according to one embodiment of the invention. Flow begins in step 110, and control passes to step 112.

In step 112, an input audio signal is received, filtered, and divided into frames. In one embodiment, the audio sequence is filtered using an anti-aliasing low pass filter, sampled at a frequency of approximately 8000 Hz or greater, and digitized into 8 or 16 binary bits. The input audio signal is processed by a filter emphasizing high spectrum frequencies. An exemplary filter utilized in one embodiment of the invention is described in further detail below. The filtered sequence is divided into overlapping frames (or segments) each containing N samples. While one embodiment is described wherein the input audio signal is filtered prior to data compression, alternative embodiments do not necessarily filter the input audio signal. Furthermore, alternative embodiments of the invention could perform sampling at any frequency and/or digitize samples into any length of binary bits.

From step 112, control passes to step 114. In step 114, the frames are transformed. In one embodiment, the frames are transformed two at a time using a discrete (Fast) Fourier Transform (FFT) technique described in further detail below. Although each transformed frame has N coefficients (each coefficient having a real component and an imaginary component), only N/2+1 coefficients need to be calculated (the second N/2 real components are the same as the first N/2 real components in reversed order, while the second N/2 imaginary components are the same as the first N/2 imaginary components in reversed order and taken with a minus sign). It should be appreciated that while one embodiment of the invention performs a (Fast) Fourier Transform, alternative embodiments may use any number of transform techniques. Yet other embodiments do not necessarily perform a transform technique.

Once a frame transformation is completed in step 114, steps 116–128 are performed on the transformed frame. Although steps 116–128 are performed separately on each transformed frame, embodiments can be implemented that perform steps 116–128 on multiple transformed frames in parallel. In step 116, the most substantial No spectral (transform) coefficients are selected from the N/2+1 coefficients representing the transformed frame. To select the most substantial $N_0$ spectral coefficients, the transform coefficients are sorted in accordance with a predetermined criteria. For example, in one embodiment, the N/2 +1 transform coefficients are sorted by decreasing absolute values. In an alternative embodiment, the sum of absolute values of the real and the imaginary parts of the transform coefficients are used to sort the coefficients. Thus, any number of techniques may be used to sort the transform coefficients. Furthermore, it should be appreciated that alternative embodiments of the invention do not necessarily sort the transform coefficients. While one embodiment of the invention determines the number $N_0$ adaptively depending on characteristics of the current frame of the input audio signal, alternative embodiments use a fixed value for $N_0$. Using relatively large values of $N_0$ typically results in relatively "rough" quantization which may be more suitable for wideband frames, while using relatively smaller values of $N_0$ results in relatively precise quantization which may be more appropriate for narrowband frames. One embodiment uses a value for $N_0$ in the range of 30 . . . 70 for N=256. Using $N_0$=30 typically yields a bit rate of approximately 8 kbps, while using $N_0$=70 typically results in a bit rate of approximately 16 kbps.

While one embodiment of the invention selects only some of the transform coefficients, alternative embodiments can be implemented to sometimes or always select all of the transform coefficients. Furthermore, alternative embodiments do not necessarily select the most substantial transform coefficients (e.g., other criteria may be used to select from the transform coefficients).

From step 116, control passes to steps 118, 122 and 124. In step 118, a location vector is created identifying the locations of the selected transform coefficients relative to the frame. In one embodiment, the location vector is a binary vector having ones in positions corresponding to the selected coefficients and zeros in the positions corresponding to the unselected coefficients. As a result, the location vector has a predetermined length (N/2+1) and contains a predetermined number ($N_0$) of ones. In alternative embodiments, any number of techniques could be used to identify the selected/unselected coefficients. From step 118, control passes to step 120. In step 120, the location vector is encoded using combinatorial encoding, as will be described in greater detail below, and control passes to step 128.

In step 122, a sign vector is created identifying the signs of the selected transform coefficients. In one embodiment, the sign vector is a binary vector having ones in the relative locations of the positive coefficients and zeros in the relative locations of the negative coefficients. From step 122 control passes to step 128.

In step 124, a magnitude vector is created that comprises the absolute values of the selected transform coefficients. Using the magnitude vector, as well as a composition book and a quantization scale book, a rank vector and an indicator vector are also created in step 124. The rank vector and indicator vector provide a fixed rate quantization (of the absolute values of the magnitudes) of the transform coefficients. The rank vector is then converted into a set of binary rank vectors. Step 124 will be described in further detail with reference to FIGS. 2 and 3. From step 124, control passes to step 126 wherein the set of binary rank vectors and indicator vector are encoded using combinatorial encoding, and control passes to step 128.

In step 128, the sign vector and the combinatorially encoded location, rank, and indicator vectors are multiplexed into a bit stream to provide additional data compression, and control passes to step 130 wherein the bit stream is output. The output bit stream may be stored, transmitted, decoded, etc.

From step 130, control passes to step 132 where flow ends.

Pre-Filtering (Step 112)

In one embodiment, the cutoff frequency of the filter used in step 112 is approximately equal to half of the sampling frequency. For example, assuming that $\{s_i\}$ and $(y_i\}$ are input and output sequences of the filter, respectively, for i=0,1,2, . . . , then $$s(D)=s_0+s_1D+s_2D^2+\ldots$$

$$y(D)=y_0+y_1D+y_2D^2+\ldots,$$

are generating functions for input and output signals, respectively, where D is a formal variable. Also assuming that h(D) is a transfer function of the filter, then $$y(D)=h(D)s(D).$$

For example, in one embodiment of the invention, a filter of the order L (L is assumed to be even) having a pulse response given by $$h(D)=-(A/L)-(A/L)D-(A/L)D^2-\ldots-(A/L)D^{L/2}+D^{L/2+1}-(A/L)D^{L/2+2}-\ldots-(A/L)D^L$$

is used, where L=16 and A=1. In an alternative embodiment, A=½.

Since a limited number of transform coefficients are quantized and encoded, it s desirable to use the transform coefficients which contain the most significant portion(s) of the signal energy (i.e., the components of the audio signal which contribute most to audible quality). A preliminary filtration of the input sequence by a filter such as the one described above makes it possible to reduce compression bit rates since most of the energy of the filtered signal is concentrated in a relatively smaller number of values (e.g., transform coefficients) that will be encoded. In addition the above filter can be performed using integer arithmetic and does not require multiplication operations, and therefore, a lower cost implementation is possible.

While one type of filter has been described for filtering an input audio signal, alternative embodiments of the invention may use any number of types of filters and/or any number of values for the coefficients (e.g., A, L, etc.). Furthermore, alternative embodiments of the invention do not necessarily filter an input audio signal prior to encoding.

Fast Fourier Transform (Step 114)

As described above with respect to step 114, each frame in the filtered sequence contains N samples. Furthermore, successive frames overlap in M samples to prevent edge effects (Gibbs effect). Thus, each (current) frame that is processed comprises N-M "new" samples, since M samples overlap with a portion of the previous frame (unless the current frame is the first frame in the sequence of frames). In one embodiment, the values N=256 and M=8 are used.

The samples are transformed using a (Fast) Fourier Transform technique. The Fourier transform coefficients $Y_k$ are calculated in step 114 using the equation $$y_k=\sum_{i=0}^{N} y_i \exp\left(-j\frac{2\pi}{N}ik\right) k=0,1,2,\ldots,N-1$$

where $j=\sqrt{-1}$, and $Y_i$ represents the samples of the signal in the current frame.

Using a Fast Fourier Transform (FFT) algorithm, some of the transform coefficients are expressed using predetermined values for other coefficients, since the input sequence $\{y_i\}$ is a real sequence. The symmetrical identity, $$Y_k=Y^*_{N-k}\ k=0,1,\ldots,N-1$$

wherein Y* denotes the complex conjugate of Y, provides a relatively efficient method for determining values for the transform coefficients. Since the sequence repeats itself or the complex conjugate of itself, only half of the transform coefficients need to be calculated for k=0,1, . . . , N/2 because the other half of the transform coefficients can be determined using the above identity.

Furthermore, transform coefficients can be calculated for two successive frames simultaneously. For example, taking samples of a first frame to represent the real portion of the (filtered) input sequence and samples of a second frame to represent the imaginary portion of the input sequence, then $$x_i=Y_i^{(1)}+jy_i^{(2)},$$

where $y_i^{(1)}$ and $y_i^{(2)}$ are the samples of the first and second frames, respectively, for i=0, 1, . . . ,N−1 and where $x_i$ represents the result of combining the samples for the two successive frames.

Finally, values of transform coefficients for the first and second frames are calculated as follows:

$$Y_k^{(1)}=(X_k+X^*_{N-k})/2$$

$$Y_k^{(2)}=(X_k-X^*_{N-k})/2j$$

where $$k=0,1,\ldots,N/2, \text{ for even } N$$

and $$k=0,1,2,\ldots,(N-1)/2, \text{ for odd } N$$

and $X_k$ denotes a result of the transformation of $X_i$.

The FFT approach described above saves a relatively substantial amount of computational complexity relative to systems using the discrete cosine transform (DCT) method. Furthermore, by utilizing FFT, the number of bits required to transmit an allocation of selected spectrum coefficients is reduced. Base on the symmetrical nature of the transformed coefficients, the main No spectral coefficients (i.e., those representing the most audibly significant components of the input audio signal) are selected among N/2+1 spectral coefficients instead of all N coefficients as required for DCT. Again, the savings in computation and data bandwidth resulting from the FFT approach is mostly due to the symmetry of the above described identities. However, it should be appreciated that alternative embodiments may use any number of transform techniques or may not use any transform technique prior to encoding.

Fixed Rate Adaptive Quantization

Figure 2:
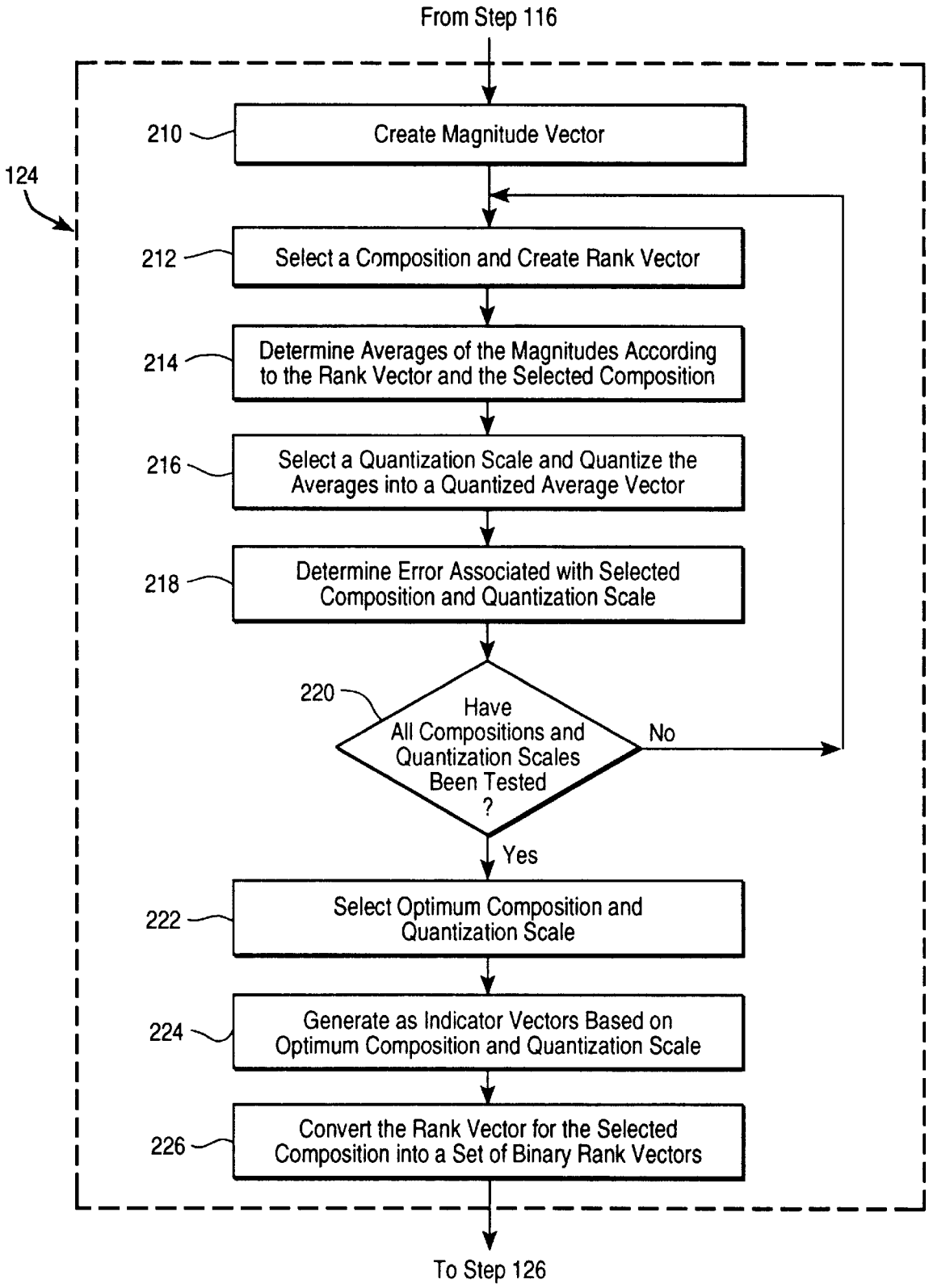
FIG. 2 is a flow diagram illustrating a method for performing fixed rate adaptive quantization according to one embodiment of the invention.
Figure 3:
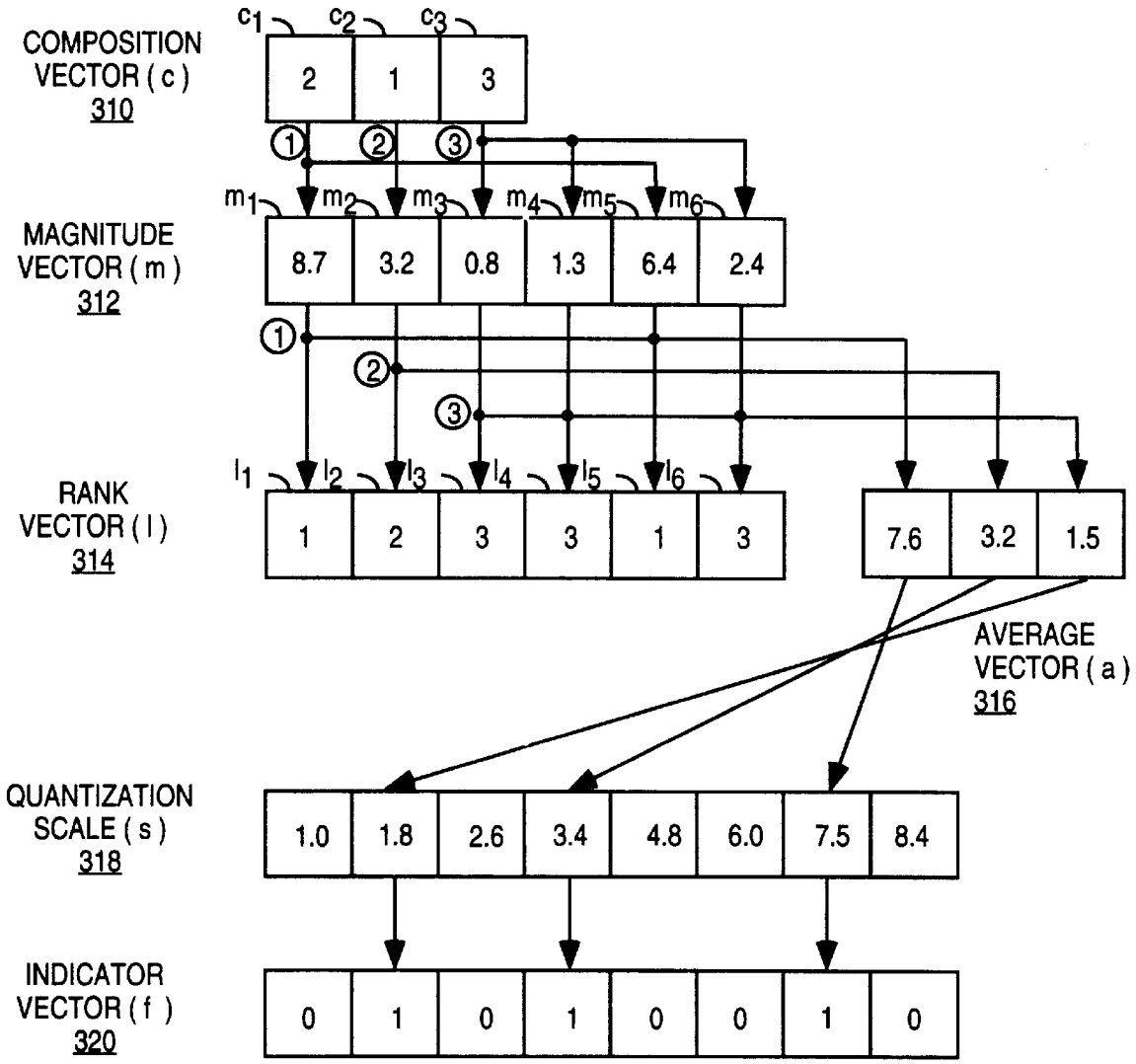
FIG. 3 is an exemplary data flow diagram illustrating vector formation for fixed rate adaptive quantization according to one embodiment of the invention.

FIG. 2 is a flow diagram illustrating a method for performing fixed rate adaptive quantization according to one embodiment of the invention, while FIG. 3 is an exemplary data flow diagram illustrating vector formation for fixed rate adaptive quantization according to one embodiment of the invention. FIG. 2 is described with reference to FIG. 3 to aid in the understanding of the invention. It should be understood that the values and dimensions of the vectors shown in FIG. 3 are exemplary, and thus, are meant only to illustrate the principle(s) of fixed rate adaptive quantization according to one embodiment of the invention.

From step 116, control passes to step 210. In step 210, a magnitude vector $m=(m_1, \ldots m_2N_0)$ is created, which magnitude vector m comprises the absolute values of the real and imaginary components of the $N_0$ selected transform coefficients, and control passes to step 212. FIG. 3 illustrates an exemplary magnitude vector (m) 312.

In step 212, a composition vector $c=(C_1, \ldots C_q)$ is selected from a set of composition vectors contained in a composition codebook. In one embodiment, the composition codebook contains three compositions, and within each composition $$\sum_{i=1}^{q} c_i = 2N_0.$$

The selected composition vector c is used for creating a rank vector $l(m,c)=(l_1, \ldots l_{2N0})$ representing groupings of the magnitudes in the magnitude vector m based on the relative values of the selected coefficients. For example, the $c_1$ largest magnitudes are selected for group 1, the $c_2$ largest remaining magnitudes are selected for group 2, etc. To provide an example, we now turn to FIG. 3.

FIG. 3 illustrates an exemplary composition vector 310 having three coordinates ($c_1$, $c_2$, $C_3$) and an exemplary rank vector having coordinates ($l_1$, $l_2$, $l_3$, $l_4$, $l_5$, $l_6$). As shown in FIG. 3, $c_1$ is "2" and the two largest magnitudes in the magnitude vector 312 (the $m_1$ and $m_5$ coordinates) are grouped together as group 1 (illustrated by a circled 1 in FIG. 3). Accordingly, a "1" is placed in the corresponding $l_1$ and $l_5$ coordinates of the rank vector 314 to identify the corresponding $m_1$ and $m_5$ coordinates of the magnitude vector 312 are in the first group (i.e., the group comprising the two largest relative values of the coordinates in the magnitude vector 312). Similarly, the $c_2$ coordinate is "1" and the next (one) largest magnitude ($m_2$) of the remaining magnitudes ($m_2$, $m_3$, $m_4$, $m_6$) in the magnitude vector 312 is placed in group 2 (illustrated by a circled 2 in FIG. 3). Thus, a "2" is placed in the rank vector 314 at the corresponding $l_2$ coordinate. In a similar manner, the $c_3$ coordinate of the composition vector 310 is "3" and the remaining three largest coordinates ($m_3$, $m_4$, $m_6$) are placed in group 3 (illustrated by a circled 3 in FIG. 3). Accordingly, a "3" is placed in the rank vector 314 at the $l_3$, $l_4$, and $l_6$ locations, which correspond to $m_3$, $m_4$, and $m_6$ (the third largest of the remaining values in the magnitude vector), respectively, of the magnitude vector 312.

In step 214, the magnitudes of the selected coefficients in each group, as determined by the composition vector c, are averaged to create an average vector $a=(a_1, \ldots a_q)$. Again, referring to FIG. 3 an average vector 316 is shown. The average vector 316 is created by averaging values of the magnitude vector 312 according to the composition vector 310 (i.e., values in the magnitude vector 312 in the same rank group in the rank vector 314 are averaged). For example, since the first composition group ($c_1$) comprises the values of the coordinates $m_1$ and $m_5$ of the magnitude vector 312, the values of $m_1$ and $m_5$ —namely, 8.7 and 6.4, respectively—are averaged to obtain the first coordinate (7.6) of the average vector 316. The second and third ($a_2$, $a_3$) coordinates of the average vector 316 are obtained in a similar manner.

From step 214, control passes to step 216. In step 216, a quantization scale $s=(s_1, \ldots s_Q)$ is selected from a quantization scale codebook, and using values in the selected quantization scale s that approximate values in the average vector a, a quantized average vector $\tilde{a}$ is formed, and control passes to step 218. Referring again to FIG. 3, the quantization scale 318 is used for mapping (quantizing) values in the average vector 316 . For example, the $a_1$ value 7.6 in the average vector 316 is quantized using the value 7.5 in the quantization scale 318. Similarly, the $a_2$ value 3.2 in the average vector 316 is quantized by using the values 3.4 in the quantized scale 318, etc. Thus, the quantized average vector a is (7.5, 3.4, 1.8). In one embodiment, the quantization scale codebook contains eight quantization scales that differ in scaling factors.

In step 218, quantization error E associated with the selected pair of the composition vector c and the quantization scale s is determined by the formula $$E(c, s) = \sum_{i=1}^{2N_0} (m_i - \tilde{a}1_i)^2.$$

for each pair (c, s). From step 218, control passes to step 220.

In step 220, if all of the compositions and quantization scales have been tested (for minimization of error), control passes to step 222. However, if all of the compositions and quantization scales have not been tested, control returns to step 212.

In step 222, the optimum composition vector and quantization scale pair (c, s) that minimizes quantization error is selected, and control passes to step 224. While the flow diagram in FIG. 2 illustrates that one composition vector/quantization scale pair is selected from sets containing multiple composition vectors and quantization scales, embodiments can be implemented in which the set of composition vectors and/or the set of quantization scales sometimes or always contain a single entry. If the set of composition vectors and/or the set of quantization scales currently contains a single entry, the flow diagram in FIG. 2 is altered accordingly. As an example, if both the set of composition vectors and the set of quantization scales contain a single entry, step 218, 220, and 222 need not be performed and flow passes directly from step 216 to step 224.

In step 224, the selected composition vector and quantization scale are used in creating a binary indicator vector $f(m,c,s)=(f_1, \ldots f_Q)$. The indicator vector f identifies values in the optimum quantization scale used to quantize the average vector a. With reference to FIG. 3, an exemplary indicator vector 320 is shown. The indicator vector 320 is a binary vector that identifies values in the quantization scale 318 that are used for mapping (quantizing) values in the average vector 316. For example, a "1" is placed in coordinates of the indicator vector 320 that correspond to the coordinates of the values 1.0, 3.4, and 7.5, which are used to quantize the three values (corresponding to the coordinates $a_1$, $a_2$, $a_3$) of the average vector 316. Since the selected quantization scale $s=(s_1,s_2, \ldots s_Q)$ has Q entries, the indicator vector f has Q entries. In addition, since the selected composition vector $c=(c_1,c_2, \ldots c_q)$ has q groups, the indicator vector f contains q ones. Since the indicator vector f has a predetermined length and contains a predetermined number of ones for the selected composition vector and quantization scale pair (c,s), the indicator vector can be combinatorily encoded in step 126. From step 224, control passes to step 226.

In step 226, the rank vector for the selected composition is converted into a set of binary rank vectors and control passes to step 126. In one embodiment, the rank vector is converted into a set of binary rank vectors by creating a binary rank vector for each group (except the last group) indicating the magnitudes in that group. For example, the binary rank vector for group 1 is of the same dimension as the rank vector and has ones only in the relative positions of the magnitudes in group 1; the binary rank vector for group 2 has $2N_0-c_1$ entries (the dimension of the rank vector without the group 1 entries) and has ones only in the relative positions of the magnitudes in group 2; . . . the binary vector for group (q−1) has $2N_{0-(c1}+\ldots+c_{q-2})$ entries and has ones only in the relative positions of the magnitudes in group (q−1). Group q is the remaining magnitudes and a binary rank vector is not required (however, alternatives embodiments could generate one). Each binary rank vector is of a predetermined length and contains a predetermined number of ones. For example, the first binary vector has length $2N_0$ (one entry for each magnitude) and contains $c_1$ ones (the number of magnitudes in group 1); the second binary vector has length $2N_0-c_1$ (one entry for each magnitude minus the number of magnitudes in group 1) and contains $c_2$ ones (the number of magnitudes in group 2); etc. Since each binary rank vector has a predetermined length and a predetermined number of ones, the set of binary vectors can be combinatorially encoded in step 126.

Figure 4A:
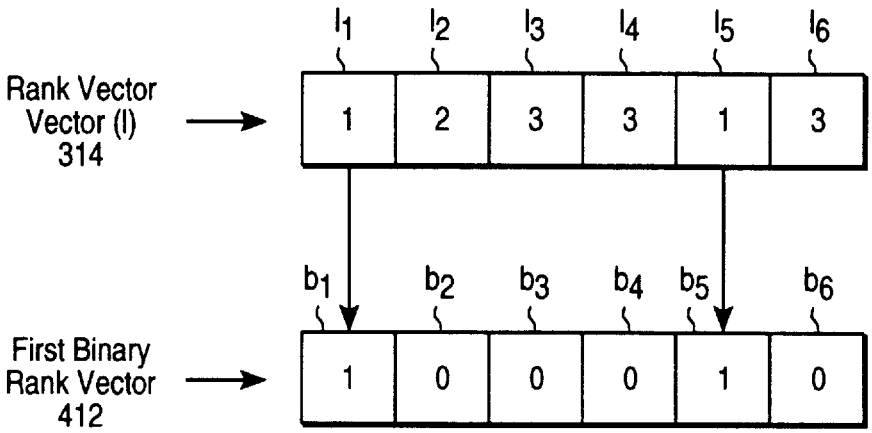
FIG. 4A is data flow diagrams illustrating part of the transformation of the exemplary rank vector of FIG. 3 into a set of binary rank vectors according to one embodiment of the invention.
Figure 4B:
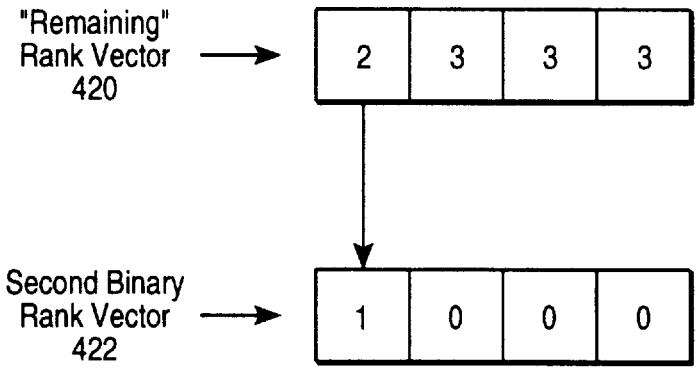
FIG. 4B is data flow diagrams illustrating another part of the transformation of the exemplary rank vector of FIG. 3 into a set of binary rank vectors according to one embodiment of the invention.

FIGS. 4A and 4B are data flow diagrams illustrating the transformation of the exemplary rank vector of FIG. 3 into a set of binary rank vectors according to one embodiment of the invention. FIG. 4A includes the rank vector 314 and a first binary rank vector 412, which is the same dimension as the rank vector 314. The first binary rank vector 412 is formed by placing a "1" in coordinates ($b_1$ and $b_5$) corresponding to the coordinates in the rank vector 314 containing "1s" ($l_1$ and $l_5$). As shown, zeros are placed into the remaining coordinates ($b_2$, $b_3$, $b_4$, $b_6$) of the first binary rank vector 412.

FIG. 4B is a data flow diagram further illustrating the transformation of the rank vector into a set of binary rank vectors according to one embodiment of the invention. FIG. 4B includes a "remaining" rank vector 420 that represents the rank vector 314 without the magnitudes in group 1. FIG. 4B further includes a second binary rank vector 422. The second binary rank vector 422 is formed in a similar manner as the first binary rank vector 412. However, since the first group (denoted by "1's") in the original rank vector 314 have been used to create the first binary rank vector 412, "1's" are placed into coordinates in the second binary rank vector 422 that correspond to the "2's" (of which there is only one) in the "remaining" rank vector 420. Again, zeros are placed into the remaining coordinates in the second binary rank vector 422.

Since it is known that the remaining magnitudes are in group 3, a third binary rank vector is not required Thus, the first binary rank vector 412 (1, 0, 0, 0, 1) and the second binary rank vector 422 (1, 0, 0, 0) identify the (non-binary) rank vector 314.

It should be appreciated that while one embodiment has been described wherein a set of binary rank vectors are formed using positive logic, alternative embodiments may utilize negative logic to form the set of binary rank vectors.

To illustrate another example, assuming a magnitude vector of m=(2.6, 1.2, 6.3, 3.3, 4.5, 3.0, 2.8, 0.4, 8.7, 2.4)

and a composition vector of c=(2, 4, 2, 1, 1), then, the resulting rank vector is l=(3,4, 1, 2, 2, 2, 2, 5, 1, 3), and the resulting average vector is a=(7.5, 3.4, 2.5, 1.2, 0.4).

Using a quantization scale of s=(0.1, 0.3, 0.9, 1.6, 2.0, 2.6, 3.2, 3.8, 4.5, 5.8, 7.6, 8.2), the quantized average vector is a=(7.6, 3.2, 2.6, 0.9, 0.3), and the indicator vector is f=(0, 1, 1, 0, 0, 1, 1, 0, 0, 0, 1, 0).

In the example above, the $c_1$ (first) coordinate in the composition vector c is a "2", which indicates that the two largest values in the magnitude vector m should be grouped together. Accordingly, a "1" is placed in the rank vector l in the coordinates ($l_3$ and $l_9$) corresponding to the coordinates ($m_3$ and $m_9$) of the values 6.3 and 8.7 (which are the first two largest values) in the magnitude vector m. Likewise, the $c_2$ (second) coordinate in the composition vector c is a "4", which indicates that the next four largest values in the magnitude vector m should be grouped together as the "second largest" group. Thus, a "2" is placed in the rank vector l in the coordinates corresponding to the positions of the values 3.3, 4.5, 3.0, and 2.8 (the next four largest values) in the magnitude vector m. The same method is used for determining groupings of the other remaining values in m to form the rank vector l.

The average vector a contains the averages of the values in each of the groups in the rank vector l. For example, the average vector's first coordinate (7.5) is the average of 6.3 and 8.7, the two (largest) values in the magnitude vector which are identified by "1" in the rank vector. Likewise, the second average vector's coordinate (3.4) represents the average of 3.3, 4.5, 3.0, and 2.8, the second next largest four magnitudes in the magnitude vector which are identified as such with "2's" in the rank vector l. Other values in the average vector a are obtained in a similar manner.

The values in the average vector a are mapped into the quantization scale s to obtain a quantized average vector $\tilde{a}$. The indicator vector f is, in essence, a binary representation of the quantized average vector $\tilde{a}$ since it indicates values in the quantization scale that are used to quantize the average vector a.

Combinatorial Encoding

In one embodiment of the invention, combinatorial encoding is performed to further compress the audio signal. Except for the sign vector, the method described with reference to FIGS. 1, 2, and 3 transforms the received audio data into a set of binary vectors (the location vector, the indicator vector f, and the set of binary rank vectors) each having a predetermined length and each containing a predetermined number of ones. Due to the predetermined nature of the resulting set of binary vectors, the resulting set of binary vectors can be combinatorially encoded.

The principle of combinatorial coding is described briefly below, and in further detail in V. F. Babkin "Method for Universal Coding of Independent Messages of Nonexponential Complexity," *Problemy Peredachi Informatsii* (Problems of Information Transmission), 1971, vol. 7, N 4, pp. 13–21, (in Russian), and T. Cover, "Enumerative Source Coding," *Transactions on Information Theory*, vol. IT-19, 1974, N1, pp. 73–77.

To illustrate the principle of combinatorial encoding as utilized in one embodiment of the invention, it is useful to consider a binary sequence of length N containing M ones and N-M zeros. Let L(N, M) be a list of all binary N-sequences with M ones written in a lexicographic order. Combinatorial encoding of a particular N-sequence x is performed by replacing x by the number of x in the list L(N, M). To illustrate, see Table 1 which shows that all possible binary sequences for N=6 and M=4 can be represented using 4 bits. As an example, the binary sequence 110101 corresponds to the number 10 in base 10, which in turn corresponds to 1010 in base 2. Thus, the sequence 110101 could be encoded using the binary codeword 1010.

TABLE 1

| L(N,M) | x in base 2 | x in base 10 |
|---|---|---|
| 001111 | 0000 | 0 |
| 010111 | 0001 | 1 |
| 011011 | 0010 | 2 |
| 011101 | 0011 | 3 |
| 011110 | 0100 | 4 |
| 100111 | 0101 | 5 |
| 101011 | 0110 | 6 |
| 101101 | 0111 | 7 |

TABLE 1-continued

| L(N,M) | x in base 2 | x in base 10 |
|---|---|---|
| 101110 | 1000 | 8 |
| 110011 | 1001 | 9 |
| 110101 | 1010 | 10 |
| 110110 | 1011 | 11 |
| 111001 | 1100 | 12 |
| 111010 | 1101 | 13 |
| 111100 | 1110 | 14 |
| Not Used | 1111 | 15 |

The number of all binary sequences in L(N, M) denoted as |L(N, M)| can be formula $$|L(M, N)| = \binom{N}{M} = \frac{N!}{M!(N-M)!}$$

Thus, x can be compressed into a binary sequence (or codeword) of length $$\left\lfloor \log_2 \binom{N}{M} \right\rfloor$$

where ⌊s⌋ the smallest integer not less than z.

Using the Pascal identities, code words with computational complexity proportional to $N^2$ can be computed. In one software implemented embodiment of the invention, wherein all possible binomial coefficients are stored, the complexity is proportional to N.

Since the quantized averages $(a_1, \ldots, a_q)$ in the quantized average vector are uniquely defined by the binary indicator vector f(m,c,s) having length Q and exactly q non zero components, combinatorial coding of f(m,c,s) requires $$\left\lfloor \log_2 \binom{Q}{q} \right\rfloor$$

bits.

The binary location vector representing the locations of the No selected transform coefficients in the domain of integers {1,2,. . . ,N/2+1} can be combinatorially encoded using $$\left\lfloor \log_2 \binom{N/2+1}{N_0} \right\rfloor$$

bits.

Combinatorial coding can also be used for encoding the quantized absolute values of the selected transform coefficients—namely, the binary rank vector(s). If L(m,c) represents a list of all rank vectors l(m,c), it is sufficient to find a number of l(m,c) in L(m,c) to encode a particular l(m,c). Any such vector l(m,c) is a $2N_0$-dimensional q-ary vector with a fixed composition $c=(c_1, \ldots, c_q)$. Since the number of such vectors is equal to the polynomial coefficient $$(2N_0)!/(c_1!c_2!\ldots c_q!)$$

the number of bits sufficient to encode l(m,c) is $$\left\lfloor \log_2 \frac{(2N_0)!}{c_1!c_2!\ldots c_q!} \right\rfloor < \left\lfloor \log_2 \binom{2N_0}{c_1} \right\rfloor +$$

-continued $$\left\lfloor \log_2 \binom{2N_0 - c_1}{c2} \right\rfloor + \ldots +$$

$$\left\lfloor \log_2 \binom{2N_0 - c_1 - c_2 - \ldots - c_q - 2}{c_q - 1} \right\rfloor$$

The first term in the right hand part corresponds to the number of bits required to represent the positions of "1's", the second term provides the positions of "2's", etc. Positions of 1's, 2's, (q−1)'s can be described by binary vectors of length $2N_0$, $2N_0-c_1$, $2N_0-c_1-c_2-, \ldots c_q-2$ with $c_1, c_2, \ldots, C_q-1$ nonzero components, respectively.

Exemplary Compression Systems

Figure 5:
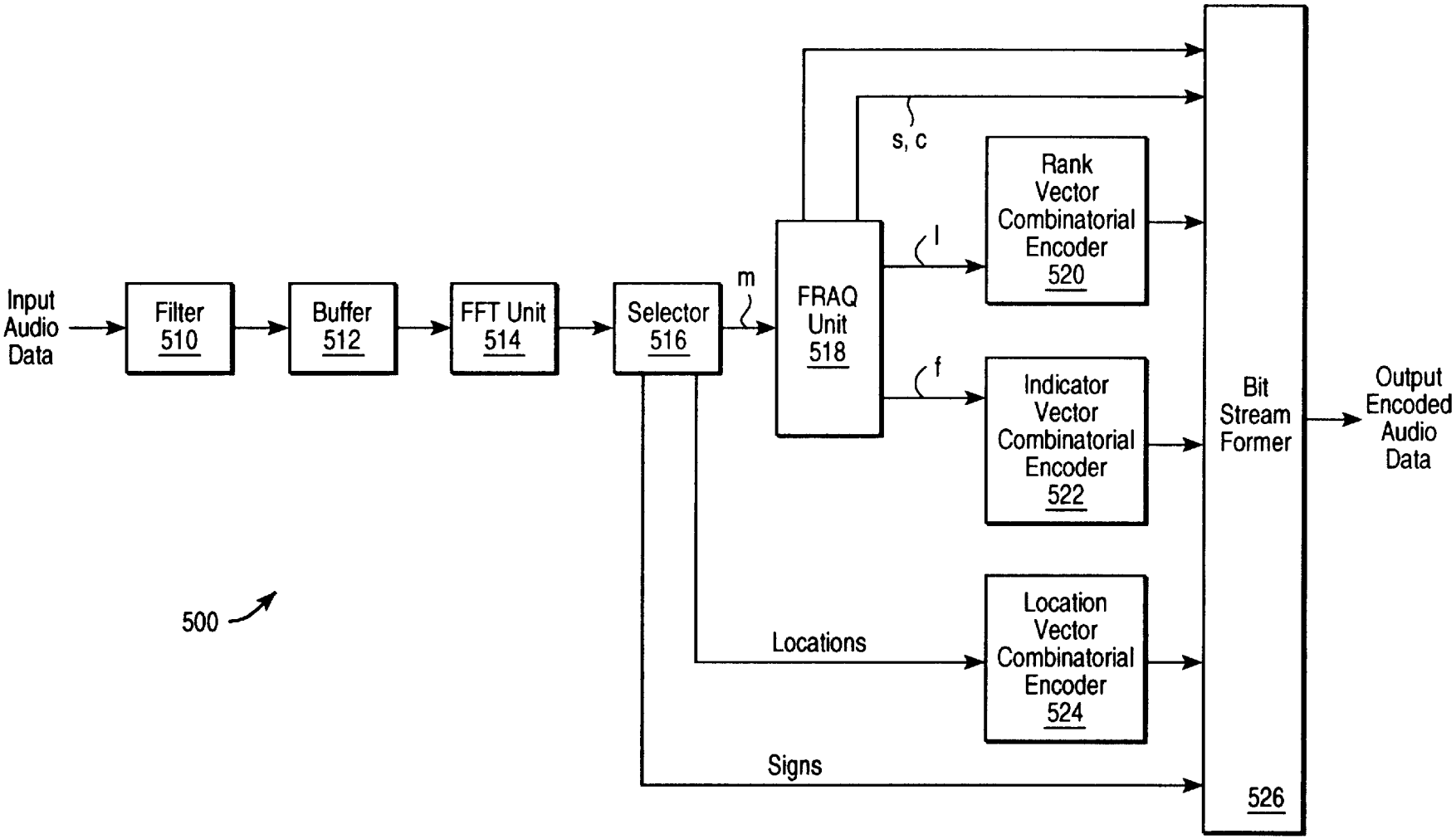
FIG. 5 is a block diagram of an audio data compression system according to one embodiment of the invention.
Figure 6:
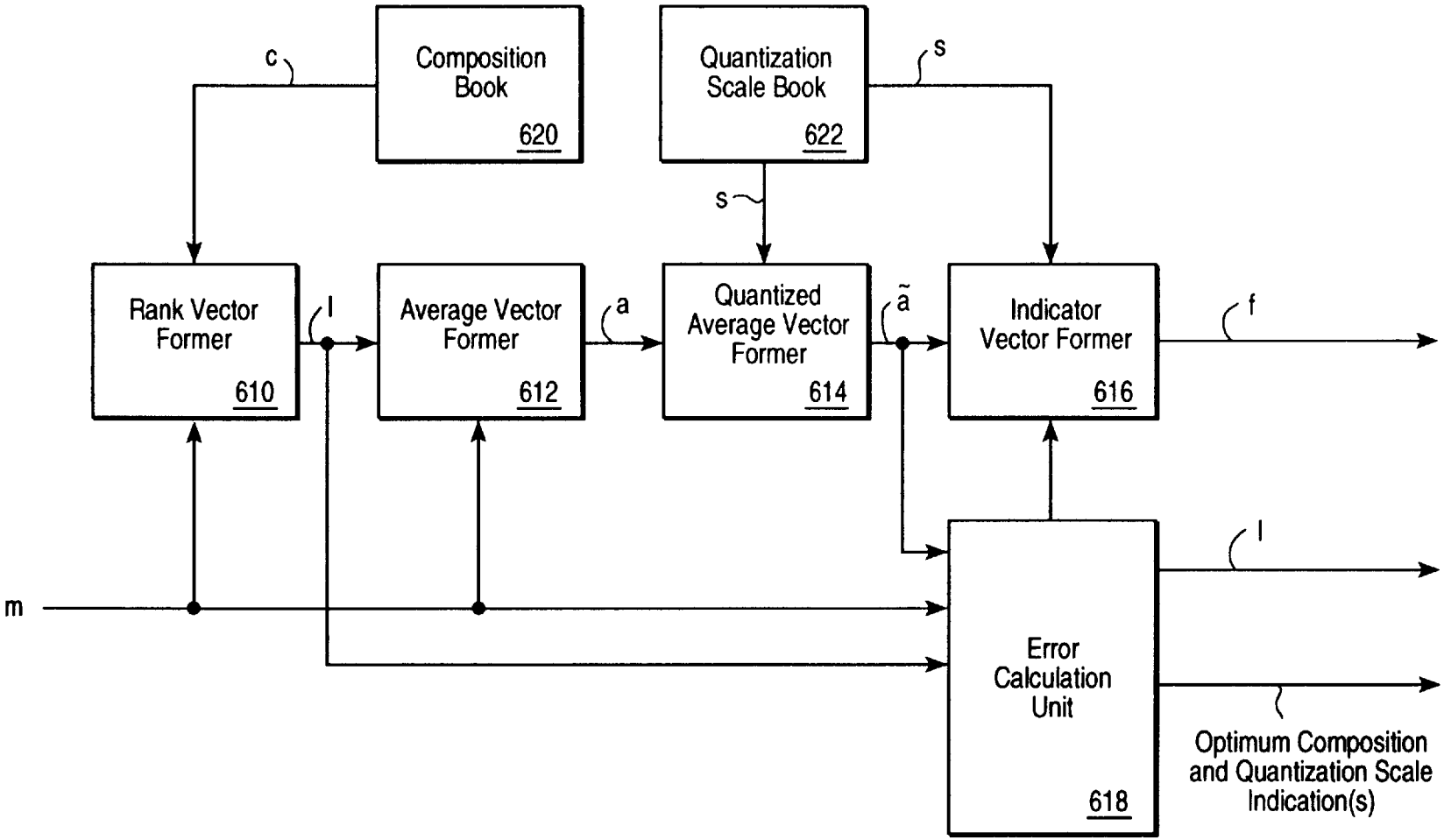
FIG. 6 is a block diagram of the fixed rate adaptive quantization unit from FIG. 5 according to one embodiment of the invention.

FIG. 5 is a block diagram of an audio data compression system according to one embodiment of the invention, while FIG. 6 is a block diagram of the fixed rate adaptive quantization (FRAQ) unit from FIG. 5 according to one embodiment of the invention. It is to be understood that any combination of hardwired circuitry and software instructions can be used to implement the invention, and that all or part of the invention may be embodied in a set of instructions stored on a machine readable medium (e.g., a memory, a magnetic storage medium, an optical storage medium, etc.) for execution by one or more processors. Therefore, the various blocks of FIGS. 5 and 6 represent hardwired circuitry and/or software units for performing the described operations. For example, all or part of the system shown in FIGS. 5 and 6 may be implemented on a dedicated integrated circuit (IC) board (or card) that may be used in conjunction with a computer system(s) and/or other devices. This IC board may contain one or more processors (dedicated or general purpose) for executing instructions and/or hardwired circuitry for implementing all or part of the system in FIGS. 5 and 6. In addition, all or part of the system in FIGS. 5 and 6 may be implemented by executing instructions on one or more main processors of the computer system.

The audio compression system 500 in FIG. 5 operates in a similar manner to the flow diagrams shown in FIGS. 1 and 2. The alternative embodiments described with reference to FIGS. 1 and 2 are equally applicable to the system 500. For example, if in an alternative embodiment, the input audio data is not filtered, then the filter 510 shown in FIG. 5 would not be present. The system 500 includes a filter 510 that receives the input audio signal. The filter 510 may be any number of types of filters. The filter 510 filters out relatively low spectrum frequencies, thereby emphasizing relatively higher spectrum frequencies, and outputs a filtered sequence of the input audio signal to a buffer 512.

The buffer 512 stores digitized samples of the filtered sequence. The buffer 512 is configured to store samples from a current frame of the input audio signal to be processed by the system 500, as well as samples from a portion of a previously processed frame overlapped by the current frame.

The buffer 512 provides the digitized samples of the filtered sequence to a transform unit 514. The transform unit 514 transforms the samples of the filtered sequence into a plurality of transform coefficients representing two successive frames. In one embodiment, the transform unit 514 performs a Fast Fourier Transform (FFT) technique to obtain the transform coefficients. The transform unit 514 separately outputs each frame's transform coefficients to a selector 516.

The selector 516 selects a set of the transform coefficients based on a predetermined criteria. The selector 516 also outputs the sign vector comprising the signs of the selected transform coefficients to a bit stream former 516, and outputs the location vector representing the locations of the selected transform coefficients to a location vector combinatorial encoder 524. The magnitude vector m comprising the absolute values of the selected transform coefficients is output by the selector 516 to a fixed rate adaptive quantization (FRAQ) unit 518.

The FRAQ unit 518 creates and outputs the set of binary rank vectors and the indicator vector f, as well as a set of indications identifying the quantization scale s and the composition vector c used to create the set of rank vectors and the indicator vector f. The set of indications identifying the quantization scale and the composition vector are output to the bit stream former 526. The set of rank vectors and the indicator vector are respectively output by the FRAQ unit 518 to a rank vector combinatorial encoder 520 and an indicator vector combinatorial encoder 522. The FRAQ unit 518 will be described in further detail below with reference to FIG. 6.

The combinatorial encoders 520, 522, and 524 combinatorially encode the set of rank vectors, the indicator vector, and the location vector, respectively, and provide combinatorially encoded data to the bit stream former 526.

The bit stream former 526 provides further data compression by multiplexing the set of indications identifying the quantization scale and the composition vector, the sign vector, and the combinatorially encoded binary rank, indicator, and location vectors into one bit stream that may be transmitted, stored, etc.

FIG. 6 is a block diagram of the fixed rate adaptive quantization (FRAQ) unit from FIG. 5 according to one embodiment of the invention. The FRAQ unit 518 comprises a composition book 620, a quantization scale book 622, a rank vector former 610, an average vector former 612, a quantized average vector former 614, an indicator vector former 616, and an error calculation unit 618.

The composition book 620 and the quantization scale book 622 comprise a set of predetermined compositions and a set of predetermined quantization scales, respectively. A composition vector c from the composition book 620 and a magnitude vector m comprising absolute values of a set of transform coefficients representing an audio signal are provided to the rank vector former 610. Using the composition vector and the magnitude vector, the rank vector former 610 creates and outputs the rank vector l to the average vector former 612.

The average vector former 612 uses the rank vector and the magnitude vector to form the average vector a. The average vector former provides the average vector to the quantized average vector former 614.

In addition to the average vector, the quantized average vector former 614 receives a quantization scale s from the quantization scale book 622. Using the quantization scale and the average vector, the quantized average vector former 614 creates a quantized average vector $\hat{a}$. The quantized average vector is provided by the quantized average vector former 614 to the indicator vector former 616.

The indicator vector former 616 uses the quantized average vector and the quantization scale s to create and output the indicator vector f.

The error calculation unit 618 determines error associated with the set of composition vectors and quantization scales and determines the optimum pair of the composition vector and the quantization scale that minimizes quantization error.

While embodiment one is described wherein a composition book (containing a plurality of composition vectors) and a quantization book (containing a plurality of quantization scales) is described, alternative embodiments of the invention do not necessarily use more than one composition vector and/or one quantization scale. Furthermore, alternative embodiments of the invention do not necessarily include an error calculation unit for determining quantization error associated with a composition vector and/or a quantization scale. In addition, while FIG. 5 shows three combinatorial encoders, one or two combinatorial encoders can be used to perform all of the combinatorial encoding.

DECOMPRESSION

Figure 7:
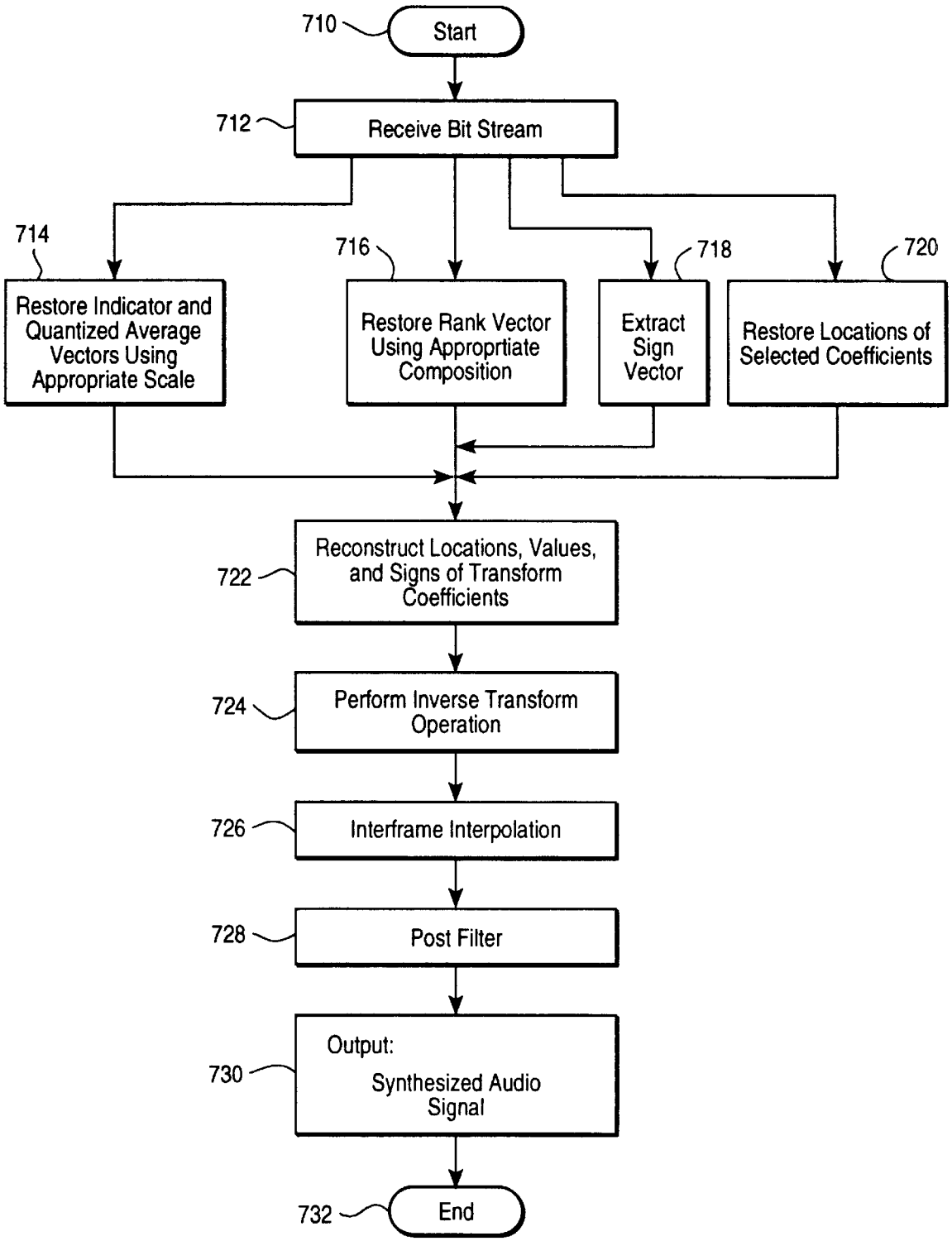
FIG. 7 is a flow diagram illustrating a method for decompression of audio data according to one embodiment of the invention.

Overview of Audio Decompression According to One Embodiment of the Invention FIG. 7 is a flow diagram illustrating a method for decompression of audio data according to one embodiment of the invention. It should be understood that the audio signal is decompressed based on the manner in which the audio signal was compressed. As a result, alternative embodiments previously described affect and are applicable to the decompression method described below. Flow begins in step 710, from which control passes to step 712.

In step 712, a bit stream comprising compressed audio data representing a current frame of an audio signal is received. In the described embodiment, the bit stream comprises a combinatorially encoded set of binary rank vector (s), a combinatorially encoded indicator vector(s), a combinatorially encoded location vector(s), and a sign vector(s). In addition, if multiple composition vectors and/or quantization scales are used, the bit stream contains data indicating which composition vector and quantization scale pair was used. From step 712, control passes to steps 714, 716, 718, and 720.

In step 714, the combinatorially encoded indicator vector and quantized average vector are restored using a combinatorial decoding technique, and control passes to step 722. Similarly, in steps 716 and 720, the combinatorially encoded set of binary rank vector(s) and the combinatorially encoded location vector(s) are combinatorially decoded, respectively, and control passes to step 722. In step 718, the sign vector is extracted from the bit stream, and control passes to step 722.

In step 722, the transform coefficients are reconstructed by using the restored locations, signs, and values of the transform coefficients. From step 722, control passes to step 724.

In step 724, the transform coefficients are subjected to an inverse transform operation, and control passes to step 726. In one embodiment, the transform coefficients represent (Fast) Fourier Transform (FFT) coefficients, and thus, an inverse (Fast) Fourier transform is performed using the formula $$y_i = \sum_{k=0}^{N-1} Y_k \exp\left(j\frac{2\pi}{N}ik\right) \quad i = 0, 1, \ldots, N-1$$

to synthesize the audio signal. In alternative embodiments, any number of inverse transform techniques may be used to synthesize the audio signal.

In step 726, interframe interpolation is performed (i.e., samples stored from a portion of a previously synthesized frame that are overlapped by the current frame are used to synthesize the overlapping portion of the current frame), and control passes to step 728. Interframe interpolation typically improves the quality of the synthesized audio signal by "smoothing out" the Gibbs effect on interframe bounds. In one embodiment, the current frame overlaps the previously synthesized frame in M samples, where $y_{N-M}^{(1)}, \ldots y_{N-1}^{(1)}$ denotes the M samples of the previously decoded frame, and $y_0^{(2)}, \ldots, y_{M-1}^{(2)}$ denotes the M samples of the current frame. In the described embodiment, a linear interpolation of overlapping segments of samples denoted by $\{y_i^{(2)}\}$ is performed using the formula $$y_i^{(2)}=y_i^{(2)}(i+1)/(M+1)+y_{N-M+i}^{(1)}(M-i)/(M+1)$$

for i=0,1, . . . , M−1.

From step 726, control passes to step 728.

In step 728, the synthesized audio signal is filtered, and control passes to step 730. In one embodiment, a filter described by $$b(D)=(A/L)+(A/L)D+(A/L)D^2+\ldots+(A/L)D^{L/2}+D^{L/2+1}+(A/L)D^{L/2+2}+\ldots+(A/L)D^L$$

is used, where L=16 and A=1. In an alternative embodiment, A=½. In one embodiment, a filter which is an inverse of a pre-filter used in the compression of the audio signal is used. While several embodiments have been described wherein the synthesized (decompressed) audio signal is filtered prior to output, it should be appreciated that alternative embodiments of the invention do not necessarily use a filter or may use any number of various types of filters.

In step 730, the synthesized audio signal is output (e.g., for transmission, amplification, etc.), and control passes to step 732 where flow ends.

Exemplary Decompression Systems

Figure 8:
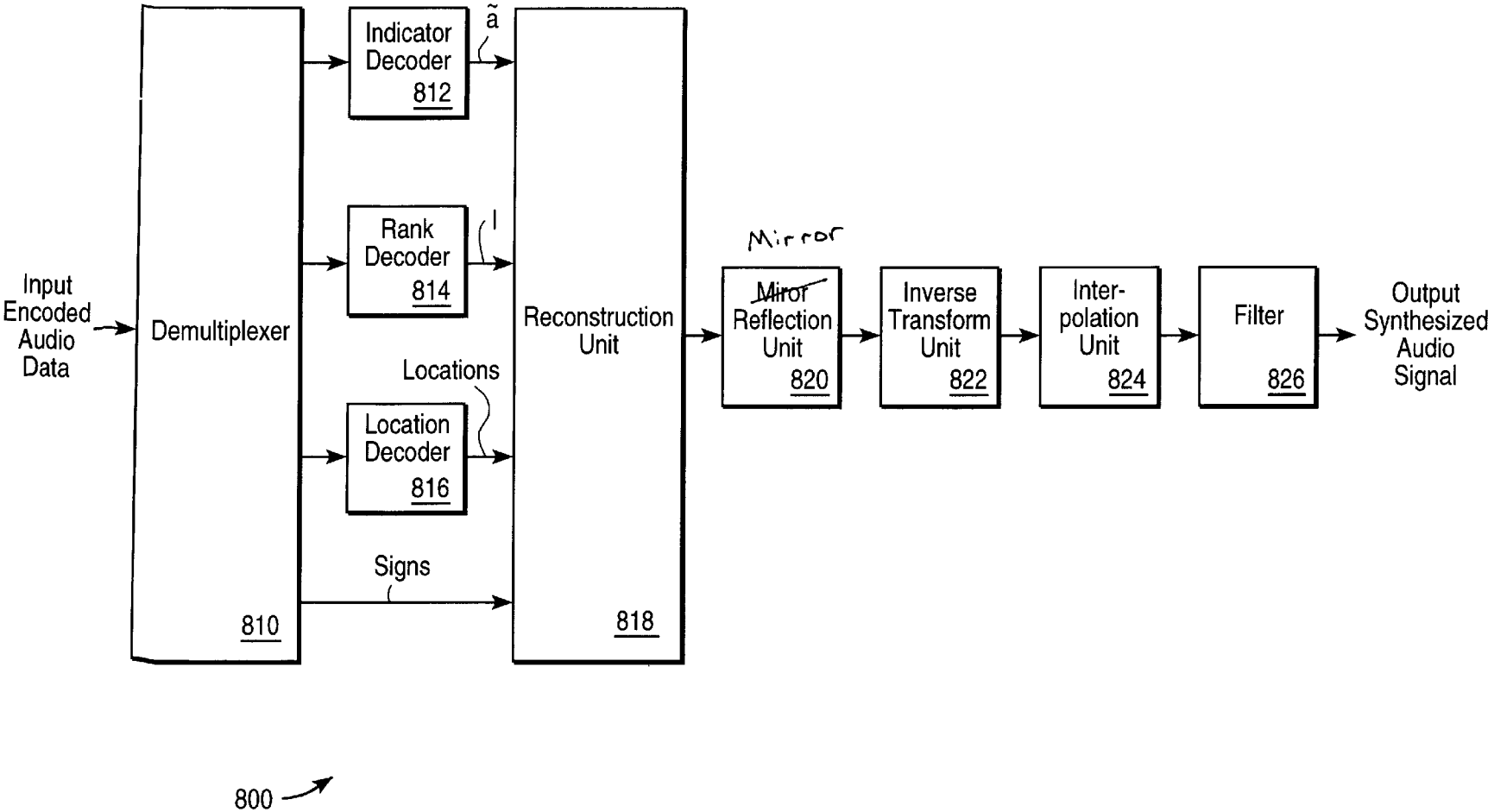
FIG. 8 is a block diagram of an audio data decompression system according to one embodiment of the invention.

FIG. 8 is a block diagram of an audio data decompression system according to one embodiment of the invention. It is to be understood that any combination of hardwired circuitry and software instructions can be used to implement the invention, and that all or part of the invention may be embodied in a set of instructions stored on a machine readable medium (e.g., a memory, a magnetic storage medium, an optical storage medium, etc.) for execution by one or more processors. Therefore, the various blocks of FIG. 8 represent hardwired circuitry and/or software units for performing the described operations. For example, all or part of the system shown in FIG. 8 may be implemented on a dedicated integrated circuit (IC) board (or card) that may be used in conjunction with a computer system(s) and/or other devices. This IC board may contain one or more processors (dedicated or general purpose) for executing instructions and/or hardwired circuitry for implementing all or part of the system in FIG. 8. In addition, all or part of the system in FIG. 8 may be implemented by executing instructions on one or more main processors of the computer system.

The decompression system 800 shown in FIG. 8 comprises a demultiplexer 810 that receives and demultiplexes an input bit stream generated by a compression technique similar to that previously described. The demultiplexer 810 provides the encoded indicator vector to an indicator vector decoder 812 that combinatorially decodes the indicator vector to restore the quantized average vector. The indicator vector decoder 812, in turn, provides the quantized average vector to a reconstruction unit 818. The demultiplexer 810 also provides the encoded set of binary rank vector(s) and the encoded location vector to a rank vector decoder 814 and a location vector decoder 816, respectively, wherein the set of binary rank vector(s) and the location vector are combinatorially decoded. The restored set of binary rank vectors are then converted into the non-binary rank vector. The restored non-binary rank vector and the restored location vector are provided by the rank vector decoder 814 and the location vector decoder 816, respectively, to the reconstruction unit 818. The sign vector is provided directly to the reconstruction unit 818 by the demultiplexer 810.

The reconstruction unit 818 places the quantized set of transform coefficients, along with the appropriate signs and (quantized average) magnitudes into positions indicated by the non-binary rank vector and the restored location vector. The restored set of transform coefficients are output by the reconstruction unit 818 to a mirror reflection unit 820.

The mirror reflection unit 820 determines a complex Fourier spectrum for the set of transform coefficients. In one embodiment, the first N/2+1 coefficients are used to determine the values of the second N/2−1 coefficients using symmetrical identities, such as the one(s) described above with reference to FIG. 1. The mirror reflection unit 820 provides the complex Fourier spectrums to an inverse transform unit 822. In the described embodiment, the inverse transform unit 822 performs a Inverse Fast Fourier Transform (IFFT) on two successive frames to synthesize the audio signal.

The synthesized audio signal provided by the inverse transform unit 822 is interframe interpolated by an interpolation unit 824 and filtered by a filter 826 prior to output.

Alternative Embodiments

While the invention has been described in terms of several embodiments, those skilled in the art will recognize that the invention is not limited to the embodiments described. The method and apparatus of the invention can be practiced with modification and alteration within the spirit and scope of the appended claims. The description is thus to be regarded as illustrative instead of limiting on the invention.

What is claimed is:

1. A machine implemented method to compress audio data, said audio data representing an audio signal, said method comprising:

receiving said audio data;

decomposing said audio signal into a set of frames;

transforming values representing a first frame of said set of frames into a set of transform coefficients;

generating a set of binary vectors representing magnitudes of said set of transform coefficients;

combinatorially encoding said set of binary vectors; and storing said combinatorially encoded set of binary vectors.

2. The method of claim 1, further comprising filtering said audio signal.

3. The method of claim 1, wherein said audio signal comprises speech.

4. The method of claim 1, further comprising:

transforming said values using a Fast Fourier Transform (FFT).

5. The method of claim 1, further comprising:

separating the signs from said set of transform coefficients prior to generating said set of binary vectors; and storing indications identifying said signs of said set of transform coefficients.

6. The method of claim 1, further comprising:

selecting a subset of transform coefficients from said set of transform coefficients;

generating said set of binary vectors based on said subset of transform coefficients; and generating a second binary vector representing locations in said first frame of said subset of transform coefficient.

7. The method of claim 6 further comprising:

combinatorially encoding said second binary vector; and storing said combinatorially encoded second binary vector.

8. The method of claim 1, wherein generating said set of binary vectors further comprises grouping the magnitudes to be represented by said set of binary vectors into a set of groups according to a composition, said composition determining said set of groups based on a predetermined quantity and relative value of said magnitudes in each group in said set of groups.

9. The method of claim 8, wherein generating said set of binary vectors further includes:

creating a set of binary rank vectors that each identify a different one of said set of groups, said set of binary rank vectors being in said set of binary vectors.

10. The method of claim 8, further comprising selecting said composition from a set of predetermined compositions based on determining relative error associated with each of said set of predetermined compositions.

11. The method of claim 8, further comprising:

averaging the magnitudes in each group of said set of groups to generate a set of averaged magnitudes;

locating entries in a quantization scale that approximate said set of averaged magnitudes; and generating a binary indicator vector identifying located entries, said binary indicator vector being in said set of binary vectors.

12. The method of claim 11, further comprising selecting said quantization scale from a set of predetermined scales based on determining relative error associated with each of said set of predetermined scales.

13. A machine implemented method to compress data associated with coefficients representing a frame of audio data, said audio data representing an audio signal, said coefficients having an order, said method comprising:

separating the signs from said coefficients to create a first vector identifying said signs of said coefficients and a second vector identifying the magnitudes of said coefficients;

generating a set of binary vectors representing said second vector, each binary vector in said set of binary vectors having a predetermined length and containing a predetermined number of a particular type of bit;

encoding said set of binary vectors to generate encoded data; and storing said encoded data.

14. The method of claim 13, wherein generating said set of binary vectors further comprises:

grouping said magnitudes into a set of groups according to a composition, said composition dictating the number and relative value of said magnitudes in each group of said set of groups;

creating a set of binary rank vectors indicating the locations relative to said order of said coefficients according to said set of groups, said set of binary rank vectors being in said set of binary vectors;

averaging said magnitudes in each of said set of groups of magnitudes to create a plurality of averages; and quantizing said plurality of averages to create an indicator vector, said indicator vector being in said set of binary vectors.

15. The method of claim 13, wherein encoding said set of binary vectors further comprises combinatorially encoding said set of binary vectors to create said encoded data.

16. The method of claim 13, further comprising:

transmitting said first vector and said combinatorially encoded data.

17. The method of claim 13, further comprising:

transforming values in said frame using a Fast Fourier Transform to generate said coefficients.

18. An audio encoder comprising:

a transform unit to transform data representing a frame of an audio signal into transform coefficients;

a quantizer, coupled to said transform unit, to group magnitudes of a set of said transform coefficients into a set of groups according to a composition, said composition determining the number and relative value of said magnitudes in each group of said set of groups, said quantizer to provide a set of binary vectors that represent a quantization of said magnitudes according to said composition; and a combinatorial encoder, coupled to said quantizer, to combinatorially encode said set of binary vectors.

19. The apparatus of claim 18, wherein said transform unit performs Fast Fourier Transform (FFT).

20. The apparatus of claim 18, wherein said frame partially overlaps another frame of said audio signal.

21. The apparatus of claim 18 further comprising:

a selector, coupled to said transform unit and said quantizer, to separate signs from said set of said transform coefficients to generate said magnitudes.

22. The apparatus of claim 22, wherein said selector generates a binary location vector that identifies the relative locations in said frame of said set of said transform coefficients and provides said binary location vector to said encoder.

23. The apparatus of claim 18, wherein said composition is an optimum composition that is selected from a plurality of compositions based on determining relative error associated with each of said plurality of compositions.

24. The apparatus of claim 18, wherein said quantizer averages said magnitudes in each of said set of groups to generate a set of averaged magnitudes and determines quantization values in a quantization scale for said set of averaged magnitudes.

25. The apparatus of claim 24, wherein said quantization scale is an optimum quantization scale that is selected from a plurality of quantization scales based on determining relative error associated with each of said plurality of quantization scales.

26. The apparatus of claim 18, wherein said quantizer includes:

a rank vector former coupled to receive said magnitudes and said composition, said rank vector former also coupled to said encoder to deliver a subset of said set of binary vectors, said subset of said set of binary vectors to indicate which of said set of said transform coefficients are in each group of said set of groups.

27. The apparatus of claim 26, wherein said quantizer further includes:

an average vector former coupled to said rank vector encoder to receive said subset and coupled to receive said magnitudes;

a quantized average vector former coupled to said average vector former to receive an average vector representing the averages of the magnitudes in each group of said set of groups; and an indicator vector former coupled to said quantized average vector former and said encoder to provide one of said set of binary vectors.

28. A machine implemented method for decompression of compressed data representing a frame of an audio signal, said compressed data comprising a set of binary vectors, said method comprising:

decoding said set of binary vectors using combinatorial decoding;

determining a set of values representing said audio signal from said combinatorially decoded set of binary vectors by:

determining a set of magnitudes using a subset of said set of binary vectors;

determining a sign for each magnitude in said set of magnitudes using a sign vector extracted from said compressed data;

combining said set of magnitudes with the signs to generate a set of coefficients;

identifying locations of said set of coefficients in said frame using a location vector in said set of binary vectors;

inverse transforming said set of coefficients to generate said set of values; and synthesizing said frame of said audio signal from said set of values.

29. The method of claim 28, wherein determining said set of values includes performing an inverse Fast Fourier Transform (IFFT) operation to determine said set of values.

30. The method of claim 28, further comprising:

determining a set of groups based on a composition and a set of rank vectors in said subset, said composition dictating said groupings based on a predetermined quantity and relative value of said set of magnitudes in each group in said set of groups, said set of groups dictating an overall order of said set of magnitudes;

determining a set of entries in a quantization scale based on an indicator vector in said subset, each group in said set of groups corresponding to one entry in said set of entries; and identifying said set of magnitudes and the order of said set of magnitudes based on said set of groups and said set of entries.

31. A machine implemented method for decompression of compressed data representing a frame of an audio signal, said method comprising:

extracting from said compressed data a set of binary vectors, said set of binary vectors representing grouping of magnitudes into a set of groups according to a composition, said composition dictating said set of groups based on a predetermined quantity and relative value of said magnitudes in each group in said set of groups, said set of binary vectors also identifying an order to said magnitudes;

extracting from said compressed data an indicator vector identifying a set of entries in a quantization scale, each group in said set of groups corresponding to one entry in said set of entries;

identifying said magnitudes and the order of said magnitudes based on said set of groups and said set of entries; and synthesizing said frame using said set of magnitudes.

32. The method of claim 31, wherein extracting from said compressed data said set of binary vectors includes combinatorially decoding said compressed data.

33. The method of claim 31, wherein synthesizing said frame using said magnitudes includes:

extracting from said compressed data a sign vector identifying a corresponding sign for each of said magnitudes; and combining each of said magnitudes with the corresponding sign to generate a set of coefficients.

34. The method of claim 33, wherein synthesizing said frame using said set of magnitudes includes:

inverse transforming said set of coefficients to generate a set of values; and synthesizing said frame from said set of values.

35. The method of claim 34, wherein synthesizing said frame using said set of magnitudes includes:

extracting from said compressed data a location vector identifying the locations of said set of coefficients in said frame.

36. An audio encoder comprising:

a transform unit to transform data representing a frame of an audio signal into transform coefficients;

a quantizer, coupled to said transform unit, to group magnitudes of a set of said transform coefficients into a set of groups according to a composition, said composition determining the number and relative value of said magnitudes in each group of said set of groups, said quantizer to provide a set of binary vectors that represent a quantization of said magnitudes according to said composition;

a selector, coupled to said transform unit and said quantizer, to separate signs from said set of said transform coefficients to generate said magnitudes, and wherein said selector generates a binary location vector that identifies the relative locations in said frame of said set of said transform coefficients and outputs said binary location vector; and an encoder, coupled to said quantizer and said selector, to encode said set of binary vectors and said binary location vector.

37. The apparatus of claim 36, wherein said encoder is a combinatorial encoder to combinatorially encode said set of binary vectors.

38. An audio encoder comprising:

a transform unit to transform data representing a frame of an audio signal into transform coefficients;

a quantizer, coupled to said transform unit, to group magnitudes of a set of said transform coefficients into a set of groups according to a composition, said composition determining the number and relative value of said magnitudes in each group of said set of groups, said quantizer to provide a set of binary vectors that represent a quantization of said magnitudes according to said composition wherein said quantizer comprises:

a rank vector former coupled to receive said magnitudes and said composition, said rank vector former also to provide a subset of said set of binary vectors, said subset of said set of binary vectors indicating which of said set of said transform coefficients are in each group of said set of groups;

a selector, coupled to said transform unit and said quantizer, to separate signs from said set of said transform coefficients to generate said magnitudes, and wherein said selector generates a binary location vector that identifies the relative locations in said frame of said set of said transform coefficients and outputs said binary location vector; and an encoder, coupled to said quantizer and said selector, to encode said set of binary vectors and said binary location vector.

39. The apparatus of claim 38, wherein said quantizer further includes:

an average vector former coupled to said rank vector encoder to receive said subset and coupled to receive said magnitudes;

a quantized average vector former coupled to said average vector former to receive an average vector representing the averages of the magnitudes in each group of said set of groups; and an indicator vector former coupled to said quantized average vector former and said encoder to provide one of said set of binary vectors.

40. The apparatus of claim 38, wherein said encoder is a combinatorial encoder to combinatorially encode said set of binary vectors.

* * * * *